US006012686A

United States Patent [19]

Julian

[11] Patent Number: 6,012,686

[45] Date of Patent: Jan. 11, 2000

[54] PLASTIC LINER SECURING DEVICE

[76] Inventor: Marland Ronald Julian, 2347 Campbell St., Baker City, Oreg. 97814

[21] Appl. No.: 09/141,674

[22] Filed: Aug. 27, 1998

[51] Int. Cl.[7] ..... B65D 25/16

[52] U.S. Cl. ..... 248/99; 220/495.08

[58] Field of Search ..... 248/99, 100, 101; 220/495.08, 908

[56] References Cited

U.S. PATENT DOCUMENTS

| | | | |
|---|---|---|---|
| 4,027,774 | 6/1977 | Cote | 248/99 X |
| 4,570,304 | 2/1986 | Montreuil et al. | 24/563 X |
| 4,919,374 | 4/1990 | Julian | 248/95 |
| 5,476,187 | 12/1995 | Marisco | 220/495.08 |

*Primary Examiner*—Ramon O. Ramirez

[57] ABSTRACT

A device for stretching a top of a flexible plastic liner around a top of a waste or storage container to hold it securely within the container for an indefinite period of time by inserting a folded-over or turned-down portion of the plastic liner which is outside of the container into a slot (26) of an accumulator (29) and rotating the accumulator (29) either right or left until said liner (50) is stretched tightly around the top of said container (52), then placing a restraining arm (42) under the edge of said stretched liner (50) in a manner to prevent said accumulator (29) from counter-rotating until said restraining arm (42) is released.

1 Claim, 6 Drawing Sheets

PLASTIC LINER SECURING DEVICE

BACKGROUND

1. Field of Invention

This invention relates to plastic liner securing devices, in particular, to such devices which are used for securing flexible plastic liners within waste or storage containers.

2. Description of Prior Art

In the past, flexible plastic liners have been used in waste and storage containers for easy and sanitary disposal of waste and the storage of commodities. Inventors have created several types of devices to secure plastic liners in said containers. Preventing the plastic liner from slipping into the container has been accomplished by many methods, namely, tying a knot in the excess liner material gathered at the top of the liner, using larger liners so more liner would extend down the outside of the container, using a slotted knob on the side of the container through which the twisted excess liner was threaded, using wire brackets or hold down clamps, using a rachet device to stretch the liner around the container. Most if not all of these methods have proved to be ineffective or too expensive for widespread application. For example, U.S. Pat. No. 5,735,495 to Kubota (1998) uses a complicated, u-shaped clip to hold a portion of a bag in place but allows the bag to slip into the container when being filled with heavy material and more than one is required to prevent such slippage, thereby costing more per can and requiring more labor to change bags, interferes with proper fit of container lid, and may fall off or dislocate on certain style containers when container liner is emptied; U.S. Pat. No. 5,476,187 to Marisco (1995) uses a grooved section near the top of the container which holds the liner by means of a retainer, which requires specialized manufacturing of said container and doesn't relate to all containers regardless of size or shape; U.S. Pat. No. 4,570,304 to Montreuil (1986) uses a thin piece of material with a perforated opening through which the liner is passed and thus said liner is secured around the top of the container, which presents a difficult problem of insertion of liner into the cut slot if material is rigid and allows the liner to slip backwards out of the slot if material is flexible; on close fitting liners there is not enough material to pull through the slot to secure the liner to the container, so all containers cannot be serviced with this device; U.S. Pat. No. 5,636,416 to Anderson (1997) employs a front and rear plate device to hold the liner in place, which is clumsy to operate and presents a problem of threading the bag through the opening especially on close-fitting bags where there is not enough slack liner material to use the device. U.S. Pat. No. 4,027,774 to Cote (1977) uses an ear and a notch manufactured into the container through which the twisted liner top is inserted; this application requires all containers to be manufactured with said ear and notch to use this system therefore this application does not work on containers that are not so manufactured. My own U.S. Pat. No. 4,919,374 (1990) uses a ratchet-type device to stretch a liner around rim of a container which device is affixed to said container; all embodiments use a complicated set of gears and paul in a housing which is required to keep the liner securely in place; although this device works well, it is very expensive to manufacture, requires attachment means, protrudes from the container requiring more space to store container and the end costs to the consumer are excessive, therefore limiting its application.

All plastic liner securing devices heretofore known suffer from one or more of the following disadvantages:

(a) Device requires attachment to container before use (b) Device allows slippage of liner into container (c) Device is difficult or complicated to operate (d) Devive is expensive to manufacture (e) Device is specific to one container only (f) Device is limited by liner size (g) Device hinders application of lid (h) Device must be different size for different-sized containers (i) Device protrudes from container, requiring additional storage space (l) Device can be displaced when liner is emptied

OBJECTS AND ADVANTAGES

Accordingly, several objects and advantages of the present invention are:

(a) to provide a device that does not require attachment to container for use;

(b) to provide a device which stretches the liner top to such a degree that the liner will remain suspended within the container under extreme load conditions;

(c) to provide a device which is extremely easy to operate;

(d) to provide a device which can be manufactured with automated equipment which will allow the cost to be insignificant to the problem;

(e) to provide a device which may be used on any waste container or storage container without regard to size or shape that now uses flexible plastic liners;

(f) to provide a device which is well below lid attachment area and will allow attachment of all lids to their containers;

(g) to provide a device which may be used for oversized liners or tightly fitting liners with equal success;

(h) to provide a device which fits flat against the side of the container, thereby requiring no additional storage space;

(i) to provide a device that can remain on the container and keep the liner in place when being emptied, which allows for reuse of liner.

A further object and advantage is to provide a device which uses the liner as a working part of the device so that once secured the stretched liner becomes a functional part of the device by providing the actual means of restraint and therefore is extremely difficult to dislodge from the container. Further objects and advantages are to provide a device which is of simple construction and can made of stainless steel, so that the device has no impact on the environment from disintegration of plastics or coatings, can sustain no damage and cause subsequent contamination such as can occur from peeling, chipping or breaking of material or coating and may therefore be autoclaved and thus is suitable for use in sterile environments, e.g. hospitals, nursing homes and laboratories. Still further objects and advantages will become apparent from a consideration of the ensuing description and drawings.

DRAWING FIGURES

FIG. 1 shows prior art of U.S. Pat. No. 4,919,374 to Julian (1990).

REFERENCE NUMERALS IN DRAWINGS

Figure 1:
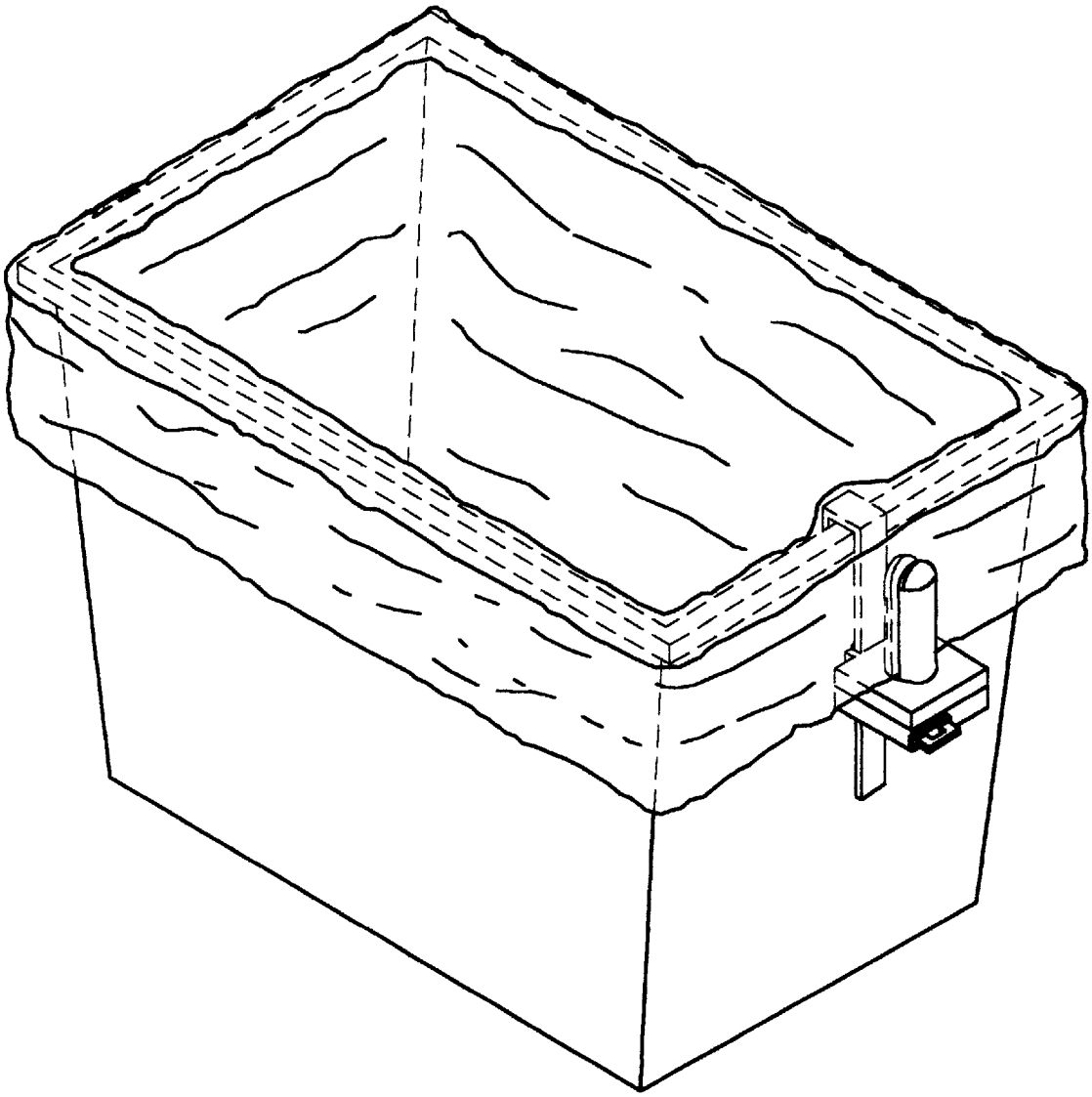
PRIOR ART FIG. 1

22 an elongated portion of accumulator
24 an elongated portion of accumulator
26 slot in accumulator
28 base of accumulator
29 accumulator
30 twisting base
32 connecting shaft
34 hole in connecting shaft
36 restraining arm shaft
38 restraining arm base
40 hole in restraining arm
42 restraining arm
44 rivet
46 rivet washer
48 hole in rivet washer
50 flexible plastic liner
52 container

SUMMARY

In accordance with the present invention a securing device comprises a flat body having two elongated portions joined to form an accumulator which with a twisting base forms the flat body and a flat restraining arm riveted to said flat body.

DESCRIPTION—FIGS. 1 to 6

FIG. 1 shows the prior art of U.S. Pat. No. 4,919,374 to Julian (1990) which shows a capability of an accumulator to stretch a plastic liner around a rim of a container.

Figure 2:
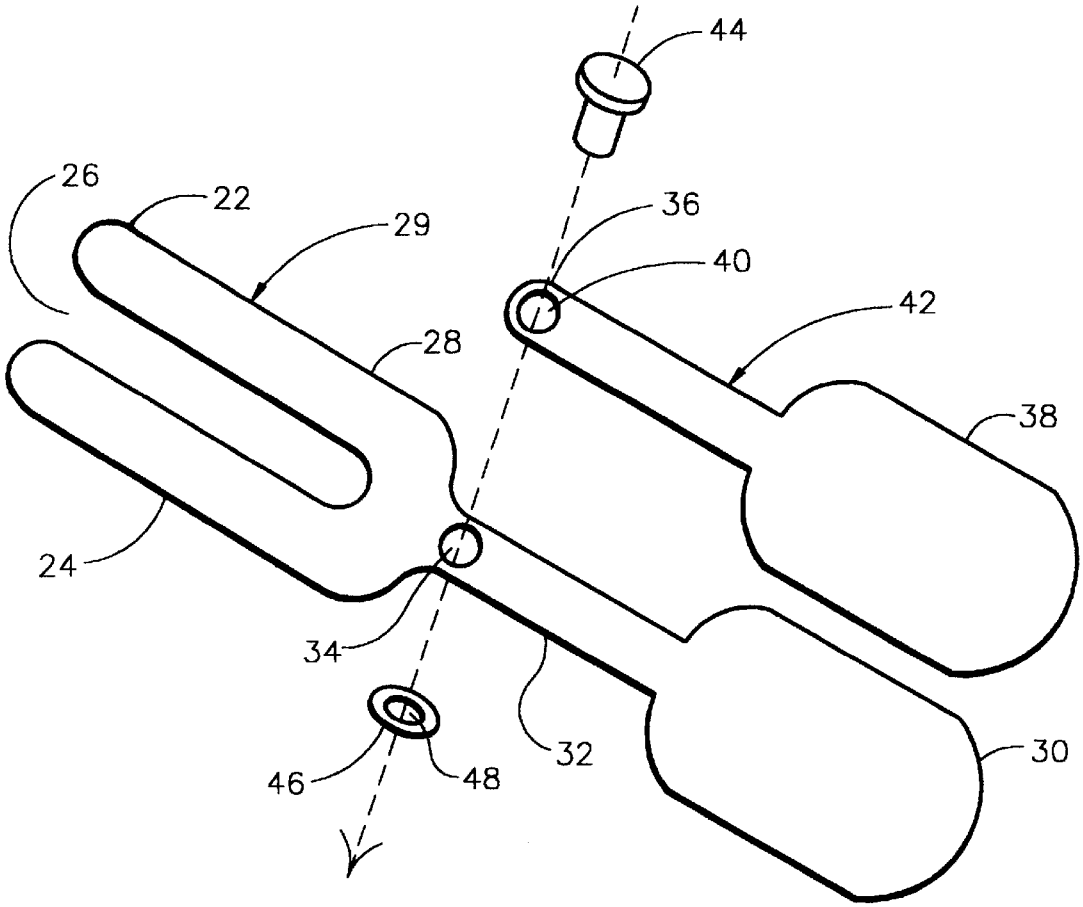
FIG. 2 shows an exploded view of the preferred embodiment.

FIG. 2 shows a typical embodiment of the present invention in an exploded view with elongated portion 22 being approximately 1½ inches long by ⅜ inch wide and elongated potion 24 being approximately 1½ inches long by ⅜ inch wide, joined together at their respective bases by base portion 28. Elongated portions 22 and 24 form slot portion 26, being approximately 1½ inches long by ⅜ inch wide. Accordingly, portions 22, 24, 26 and 28 form the accumulator portion 29 of the preferred embodiment. FIG. 2 further shows base twisting portion 30 being approximately 1¼ inches long by 1⅛ inches wide and being joined to the accumulator base portion 28 by shaft portion 32, being approximately 1¼ inches long by ⅜ inch wide. FIG. 2 further shows shaft portion 32 having a ⅛ inch diameter hole located on center approximately 2¼ inches from the bottom of twisting base portion 30. FIG. 2 further shows restraining arm 42 having base portion 38 being approximately 1¼ inches long by 1⅛ inches wide joined to restraining shaft portion 36, being approximately 1⅜ inches long by ⅜ inch wide and having a hole 40 located on center approximately 2¼ inches from the bottom of the restraining arm portion 38. FIG. 2 further shows rivet 44 approximately 3/16 inch in diameter with rivet washer 46 being approximately ⅜ inch in diameter with a center hole 48 being approximately 3/16 in in diameter connecting restraining arm 42 to shaft portion 32 through hole 40 in restraining arm 42 and hole 34 in shaft portion 32 of the device. In the preferred embodiment (FIG. 2) the thickness of all portions shall be sufficient to withstand the twisting torque associated with the application, e.g. approximately 14 gauge stainless steel. However the device may be constructed of any material which will withstand the twisting torque associated with the application.

Figure 3:
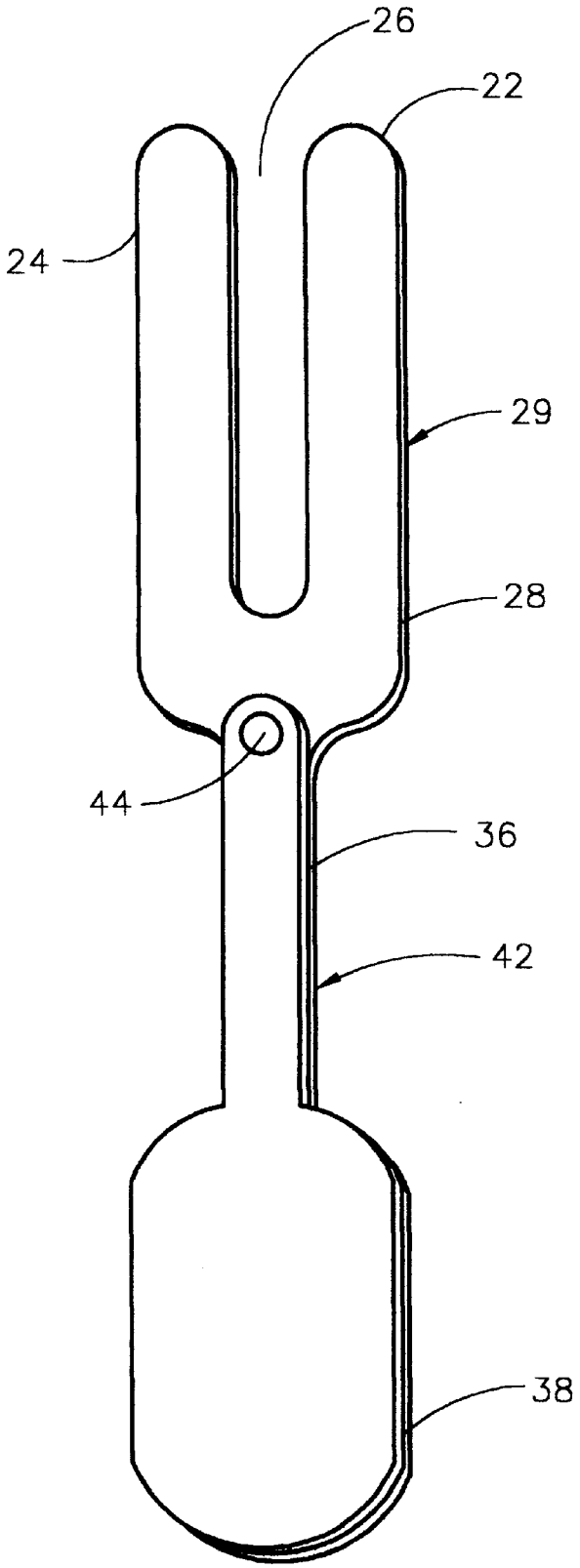
FIG. 3 shows a front view of the preferred embodiment in a passive mode.

FIG. 3 shows a front view of the preferred embodiment with the accumulator 29 and restraining arm 42 being in a vertical position.

Figure 4:
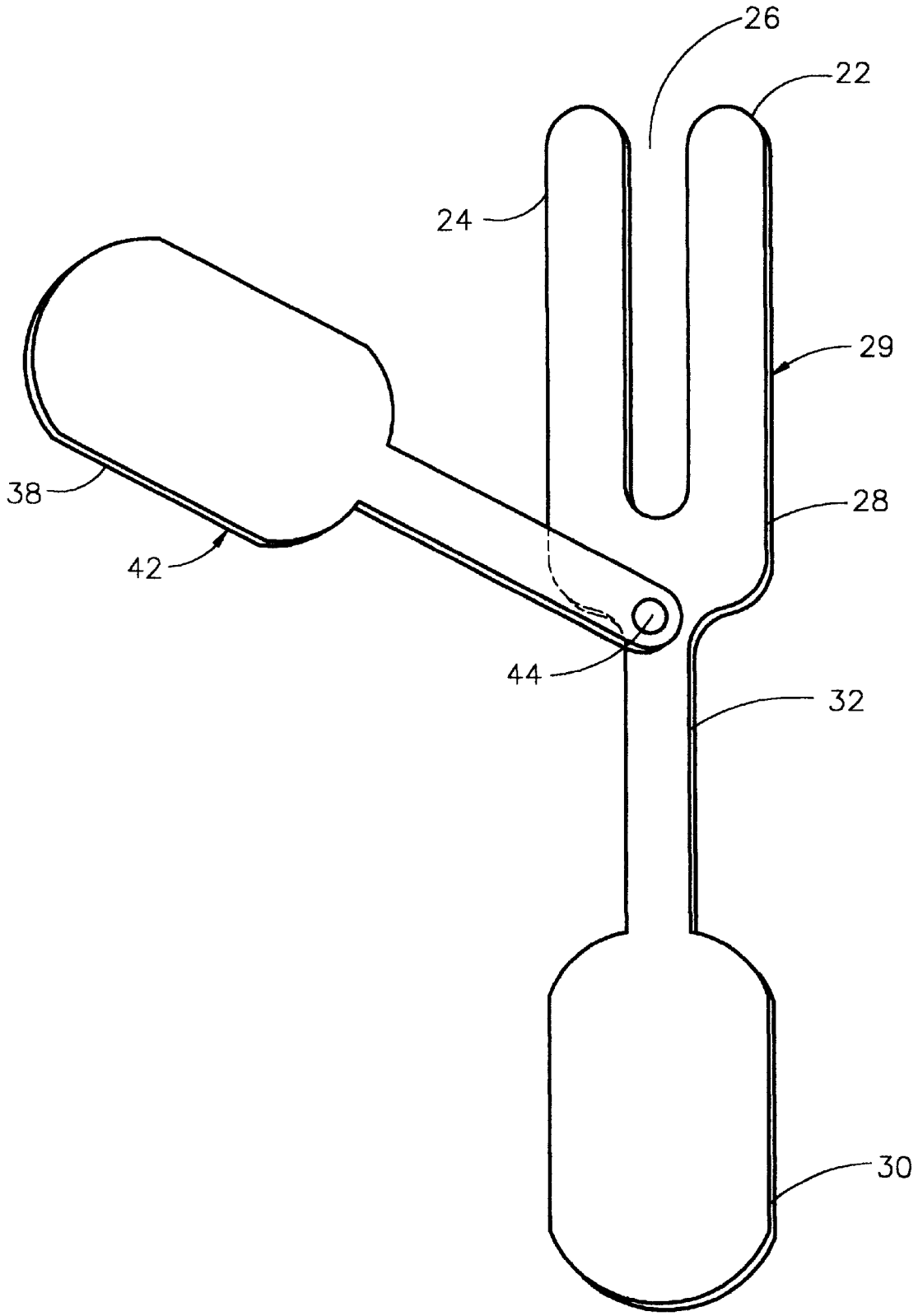
FIG. 4 shows a front view of the preferred embodiment in an active mode.

FIG. 4 shows a front view of the preferred embodiment with the accumulator 29 and base twisting portion 30 in a vertical position. FIG. 4 further shows restraining arm 42 in a raised position to the left with rivet 44 connecting restraining arm 42 to shaft portion 32 of the device.

Figure 5:
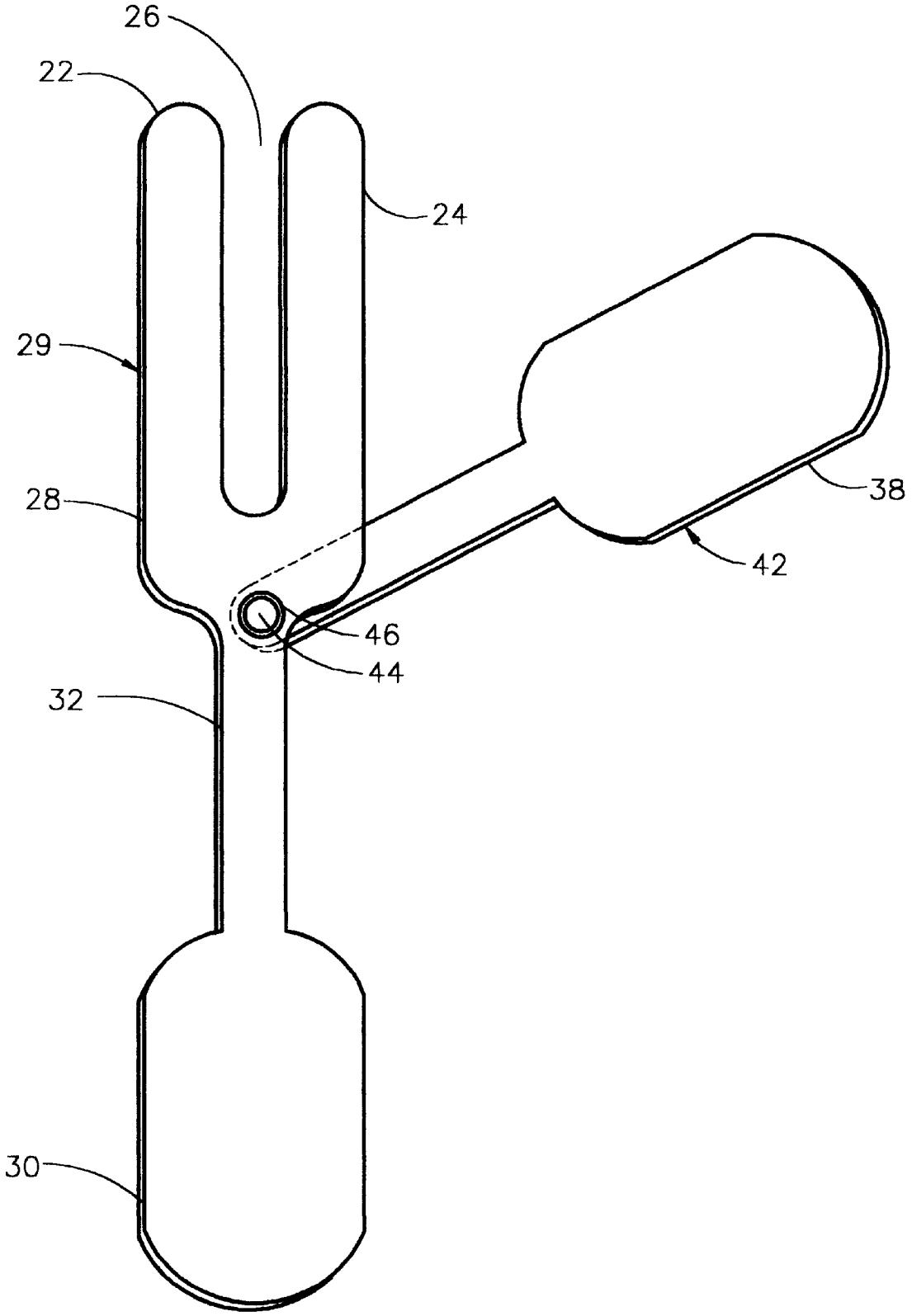
FIG. 5 shows a rear view of the preferred embodiment in an active mode.

FIG. 5 shows a rear view of the preferred embodiment with the accumulator 29 and base twisting portion 30 in a vertical position. FIG. 5 further shows restraining arm 42 in a raised position to the right with rivet 44 connecting restraining arm 42 to shaft portion 32 of the device.

Figure 6:
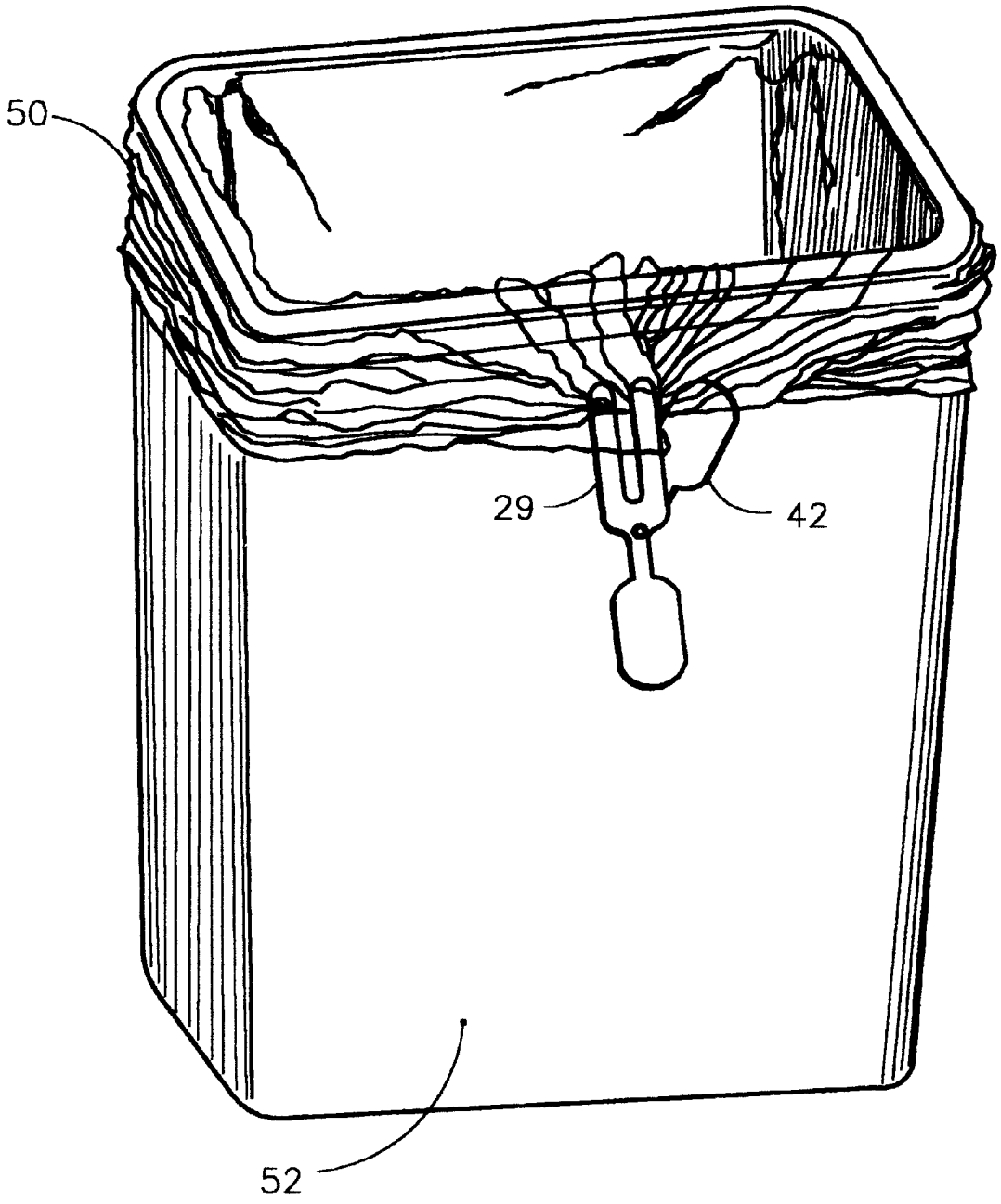
FIG. 6 shows the preferred embodiment being used with a plastic liner on a container.

FIG. 6 shows a flexible plastic liner 50 positioned within and over the lip or edge of the open container 52. FIG. 6 further shows the accumulator 29 having been rotated to the right, thereby stretching the liner 50 around container 52 until tight. FIG. 6 further shows restraining arm 42 in a raised position to the right and inserted under the edge of stretched liner top 50 to prevent counter-rotation of the accumulator.

Conclusions, Ramifications, and Scope

Accordingly, the reader will see that the plastic liner securing device can be easily attached and easily removed from a container without harming the container or impairing the use of the container lid. Furthermore, the securing device has additional advantages in that (a) it permits the container to be emptied and the liner to be reused many times without repositioning the liner within the container;

(b) the reuse of plastic liners will greatly reduce the impact of plastic liners in landfills;

(c) the preferred embodiment in stainless steel will have no coatings or chemicals released through chipping or peeling of a surface finish;

(d) it permits the liner to remain in position, firmly affixed to the container, even when the container is loaded with extreme loads;

(e) it permits the liners to be so tightly secured that smaller liners may be used, e.g., liners that do not reach the bottom of the container, thereby creating a significant cost saving and a significant reduction in the consumption of plastics used in the manufacture of said liners;

(f) it permits the device to be always on the outside of the container, with no portion being on the inside, e.g. no portion of the device being on the lip or over the rim of the container, that the device should remain free from any contaminated material placed in the container, therefore enhancing the safety of those persons handling said material.

Although the description above contains many specifications, these should not be construed as limiting the scope of the invention, but as merely providing an illustration of the preferred embodiment of this invention. For example, the device can have other shapes, such as having circular or triangular members; the accumulator can be more wide or more narrow; the slot can be of different lengths; the restraining arm can slide up and down the shaft; the rivet or other means which allow a restraining arm to bend up under the plastic liner and prevent counter-rotation of an accumulator means can be located in various places on the device. Thus the scope of the invention should be determined by the appended claims and their legal equivalents rather than by the example shown.

OPERATION—FIGS. 2,3,4,5,6

The manner of using my invention is to first position a flexible plastic liner within an open storage or waste container, with the top uppermost portion of the liner extending over and down the outside of the container two inches or more. Next, holding the device in a vertical position with the accumulator at the top, insert the raw edge of the turned down portion of the liner into the slot of the accumulator. Using the twisting base of the device, rotate the device either right or left until the liner is stretched tightly around the top of the container and the device is approximately parallel to the side of the container. (Note: the number of rotations may be reduced by folding the liner material so as to reduce the circumference of the liner top.) Next, raise the restraining arm either right or left following the rotation of the accumulator and insert the large end of the restraining arm under the edge of the stretched plastic liner top to a sufficient angle and height to prevent counter-rotation of the accumulator. To remove the device and release the liner, reverse the procedure.

I claim:

1. A plastic liner securing device for securing or attaching a flexible plastic liner folded over the top of a container, said device comprising a) an accumulator means having at least two spaced and parallel vertical portions defining a slot between them and being joined together at one end by a common base portion, and a twisting base connected to said common base by a shaft portion; and b) a restraining arm having a base portion and a shaft portion pivotally connecting the restraining arm base portion to the twisting base shaft portion; wherein the slot of the accumulator is adapted to receive the folded liner, the twisting base is capable of rotating until the liner is stretched tightly around the top of the container and the restraining arm is capable of rotating with respect to the accumulator until the restraining arm base is inserted under the edge of the liner for securing the liner in the container.

* * * * *